US007937903B2

(12) United States Patent
McGee et al.

(10) Patent No.: US 7,937,903 B2
(45) Date of Patent: May 10, 2011

(54) PANELIZED CEILING SYSTEM

(75) Inventors: Wayne McGee, Chesterfield, MO (US); Trace Woodrum, Ballwin, MO (US); Bob Weible, St. Louis, MO (US)

(73) Assignee: Portafab, Chesterfield, MO (US)

( * ) Notice: Subject to any disclaimer, the term of this patent is extended or adjusted under 35 U.S.C. 154(b) by 212 days.

(21) Appl. No.: 11/683,242

(22) Filed: Mar. 7, 2007

(65) Prior Publication Data

US 2008/0216431 A1 Sep. 11, 2008

(51) Int. Cl.
*E04B 9/00* (2006.01)

(52) U.S. Cl. ..... 52/506.09; 52/220.6; 52/775; 248/317

(58) Field of Classification Search ..... 52/281, 52/241, 280, 235, 775, 506, 506.06, 506.08, 52/488, 484, 486, 220.6, 144, 145, DIG. 13, 52/772, 323, 506.01, 506.09; 248/100, 251, 248/317, 318

See application file for complete search history.

(56) References Cited

U.S. PATENT DOCUMENTS 2,659,807 A * 11/1953 Wakefield ..... 362/150
2,803,127 A * 8/1957 Miller ..... 454/254
3,032,833 A * 5/1962 Stanley ..... 52/506.07
3,066,775 A * 12/1962 Valsvik ..... 52/506.09
3,324,967 A * 6/1967 Robinson ..... 181/290
3,359,696 A * 12/1967 Snaith ..... 52/314
3,380,206 A * 4/1968 Barnett ..... 52/145
3,461,630 A * 8/1969 Lovullo ..... 52/506.09
3,513,613 A * 5/1970 Reid et al. ..... 52/222
3,591,794 A * 7/1971 Dail et al. ..... 362/150
3,599,921 A * 8/1971 Cumber ..... 248/317
3,640,042 A * 2/1972 Kidney ..... 52/506.09
3,685,235 A * 8/1972 Lang ..... 52/39
3,832,816 A * 9/1974 Jahn ..... 52/779
4,548,010 A * 10/1985 Hintsa ..... 52/506.09
4,566,237 A * 1/1986 Turner ..... 52/269
4,671,811 A * 6/1987 Cadwell et al. ..... 55/355
4,678,487 A * 7/1987 Cadwell et al. ..... 55/385.1
4,696,141 A * 9/1987 Nassof ..... 52/506.07
4,769,958 A * 9/1988 Limp ..... 52/39
5,279,090 A * 1/1994 Yamaguchi et al. ..... 52/506.08
5,421,132 A * 6/1995 Bischel et al. ..... 52/311.3
5,495,697 A * 3/1996 Bischel et al. ..... 52/311.3
5,507,125 A * 4/1996 McClure ..... 52/506.07
5,761,869 A * 6/1998 Tinen et al. ..... 52/506.07
5,871,556 A * 2/1999 Jeanseau et al. ..... 55/385.2
5,898,987 A * 5/1999 Onofrio ..... 29/446
6,068,907 A * 5/2000 Beauregard ..... 428/71
6,101,777 A * 8/2000 Bodine et al. ..... 52/506.06
6,108,994 A * 8/2000 Bodine ..... 52/506.07

(Continued)

OTHER PUBLICATIONS

"Air-Frame™ 509 Ceiling System," Daw Tech, Feb. 2003, one page.

(Continued)

*Primary Examiner* — Basil Katcheves
*Assistant Examiner* — James Ference
(74) *Attorney, Agent, or Firm* — Lewis, Rice & Fingersh, L.C.

(57) ABSTRACT

A panel for use in constructing a ceiling of an enclosure, particularly a cleanroom without using a grid support. The panel includes a thin shell or skin which is placed around an internal bracing member in such as fashion that the resulting panel can be hung from an overhead support in a fashion to have a single join or seam between adjacent panels.

13 Claims, 9 Drawing Sheets

U.S. PATENT DOCUMENTS

| | | | | |
|---|---|---|---|---|
| 6,209,275 | B1 | 4/2001 | Cates et al. | |
| 6,230,463 | B1 * | 5/2001 | Bodine | 52/506.07 |
| 6,260,325 | B1 * | 7/2001 | Wendt et al. | 52/506.07 |
| 6,351,920 | B1 | 3/2002 | Hopkins et al. | |
| 6,368,208 | B1 | 4/2002 | Minoshima | |
| 6,389,771 | B1 * | 5/2002 | Moller | 52/506.06 |
| 6,523,314 | B1 * | 2/2003 | LaLonde et al. | 52/506.07 |
| 7,076,928 | B2 * | 7/2006 | Kliegle et al. | 52/506.09 |
| 7,712,274 | B2 * | 5/2010 | Wendt et al. | 52/506.07 |
| 2003/0213199 | A1 * | 11/2003 | Bongio et al. | 52/506.01 |
| 2004/0011935 | A1 * | 1/2004 | Groesen | 248/317 |
| 2004/0068953 | A1 * | 4/2004 | Sauer | 52/506.06 |
| 2006/0075711 | A1 | 4/2006 | Landey | |
| 2006/0162270 | A1 | 7/2006 | Maisch et al. | |

OTHER PUBLICATIONS

"Airframe™ 506/511 Ceiling Systems," Daw Tech, Mar. 2005, one page.

"Airframe™ 516 Ceiling Systems," Daw Tech, Mar. 2005, one page.

"Airframe Ceiling Systems," Daw Tech, http://www.dawtech.com/airframe.html, printed on Nov. 8, 2006, one page.

"Clean Room Mylar," Armstrong, http://www.armstrong.com/commceilingsna/ceiling_family_detail.jsp..., printed on Nov. 8, 2006, one page.

"Clean Room VL," Armstrong, http://www.armstrong.com/commceilingsna/ceiling_family_detail.jsp..., printed on Nov. 8, 2006, one page.

"Cleanroom Ceiling Systems," Portafab, http://www.portafab.com/cleanrooms_ceiling_systems.shtml, printed on Nov. 8, 2006, two pages.

"PharmaCeiling Panelized Roof," Portafab, http://www.portafab.com/pharmaceiling.html, printed on Nov. 8, 2006, two pages.

"Channel Ceil System, Vertical Laminar Flow Filter Ceiling, Bulletin PB0891-0504," Flanders PrecisionAire, undated, seven pages.

* cited by examiner

PANELIZED CEILING SYSTEM

BACKGROUND

1. Field of the Invention

The invention relates to a ceiling system, particularly a panelized ceiling system for a cleanroom or similar enclosure internal to another structure.

2. Description of the Related Art

There has recently been a steady rise in the use of cleanrooms as part of manufacturing in a variety of industries including, but not limited to, pharmaceuticals, microelectronics, biotech, food processing, surgical, and even painting applications. The need to avoid an inadvertent introduction of foreign particles into a resultant product is desirable in these types of industries to insure that the end product produced is safe, workable, and of consistent quality. In many microelectronic applications, for example, particles which are not visible to a human eye can get into a manufacturing process and render the resultant product completely inoperable. In pharmaceuticals and food preparation, an inadvertent introduction of contaminants can make the products poisonous or undesirable to use, in addition to resulting in violations of required manufacturing standards.

Most cleanrooms are generally constructed internal to other buildings or structures, and the use of such internal cleanrooms is becoming highly desirable as they are often cheaper, easier to construct, and use than having entire "clean buildings," In its most general form, building an internal cleanroom simply requires that a portion of the internal volume of the initial structure be sealed off from the resultant environmental of that structure. This portion is then supplied with its own air handling and filtration systems which serve to remove particles and the like from the air. Air is constantly flowed into the cleanroom from air handling devices which constantly remove pollutants from the environment in the form of or air suspended material using filters and related technologies. The filtered air is then returned to the internal volume of the cleanroom and cycles through again. In this way, the air is both originally clean, and is then constantly scrubbed to continually remove any introduced particles. The constant air motion also serves to move newly introduced particles away from work areas and into filters to further protect the delicate work.

Certain cleanrooms are not as concerned with particulate presence as they are with general cleanliness. These cleanrooms are designed to be repeatedly cleaned and disinfected to keep them free from the introduction of germs and other biologicals which contaminate the processes. In particular, in many pharmaceutical manufacturing processes, the introduction of a particulate on its own will not necessarily effect the resultant pharmaceutical's effectiveness, but introduction of an algal spore or virus could produce an allergic reaction in the user or even damage the product.

Traditionally, cleanrooms have been constructed of modular upright panels which form walls. These panels may then be attached to existing floors or ceilings to form the cleanroom. For more demanding applications, existing structures are not used and the clean room has an introduced floor and ceilings effectively suspending the clean room's internal volume. These constructed floors and ceiling are used as many traditional construction materials are sufficiently porous to allow an overly large amount of air to enter the clean room environment which can be prevented by using such constructed systems.

Ceilings in a cleanroom have traditionally been constructed by providing a ceiling grid which comprises a series of beams which are connected together to form a grid frame having a number of openings therethrough. Ceiling panels are then placed in each of the openings, such as on the arms of an inverted "T" shape located on the grid to form the ceiling. To provide for sealant of the panels to the grid, the grid will often have troughs formed on the inside of the arms of the T which include a gel sealant, placed in the trough in a low viscosity state. The gel is then allowed to increase in viscosity and fill the trough. Each panel then includes a knife-like edge which is pressed into the gel to form a tight seal between the panel and the grid. This seal is generally airtight and serves to seal the room.

While these systems work in many clean room applications, in some of the most demanding "clean" applications, they are unsuitable because the design necessarily creates cracks and crevices in the resultant ceiling of the cleanroom. The cracks and crevices can harbor contaminants such as mildew, even if the ceiling is cleaned regularly. This is particularly problematic in the gel based sealing system because the gel itself can attach to particulates which become difficult to remove because they are attached to the gel.

There are some grid systems designed to try and reduce and/or eliminate these cracks and crevices by providing for a flush internal surface of the ceiling of the cleanroom. These systems, however, and still dependent on the grid type of construction leaving a number of cracks in the ceiling.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are ceiling panels, a panelized ceiling, and methods for constructing a panelized ceiling which can provide for a internal surface which is generally monolithic and relatively flush for the purpose of cleaning with liquids. Particularly, the ceiling provides for fewer cracks which could harbor materials by eliminating the grid system support and therefore decreasing the number of points of connection in the ceiling's surface. This type of ceiling, therefore, will generally provide for improved cleaning and an easier to clean surface.

Described herein, among other things, is a constructed panel, for use as part of a ceiling of an enclosure, the panel comprising: a internal load bearing member, a polygonal top face placed on top of the load bearing member, a polygonal bottom face placed under the load bearing member; at least 3 sides connecting the top face to the bottom face in such a manner as to enclose the load bearing member, at least two of the sides being arranged so as to slant inward toward the load bearing member when moving from the bottom face to the top face and including at least one mounting hole therein.

In an embodiment, the enclosure is a cleanroom

In an embodiment the internal load bearing member comprises a honeycomb which may be constructed of aluminum. The top face, the bottom face, and the sides may constructed of a material selected from the group consisting of aluminum and steel and may be constructed of a single sheet bent into shape.

In an embodiment, the bottom face, the top face and the sides are constructed of a single sheet bent into shape and the top face may attached by a bend to a single of the sides or may be bonded, such as by adhesives, to at least one of the sides.

In an embodiment, at least one, and possibly all, of the side panels includes at least two mounting holes which may be sized and shaped to interface with a prong located toward a distal end of a hook.

In an embodiment, all of the sides are arranged as to slant inward toward the load bearing member when moving from the bottom face to the top face making the panel a pyramid frustum.

In an embodiment, the base is a quadrilateral which may be rectangular or square. In such arrangement, two opposing sides associated with two opposing sides of the quadrilateral are arranged to slant inward, and the other two opposing sides are arranged to be generally perpendicular to the base.

There is also described herein a panelized ceiling for a cleanroom, the ceiling comprising a plurality of constructed panels, each panel including: a internal load bearing member; a polygonal top face placed on top of the load bearing member; a polygonal bottom face placed under the load bearing member; at least 3 sides connecting the top face to the bottom face in such a manner as to form a polygonal pyramid frustum which encloses the load bearing member, each of the side panels including at least two mounting holes therein; a plurality of hooks, each of the hooks including: a main body with a distal and a proximal end and a length therebetween; at least two prongs, arranged toward the distal end of the main body and extending from the main body; and a connector located toward the proximal end; and a plurality of rods, each of the rods being connected to an overhead support and having a distal connector; wherein, the ceiling is formed by attaching the proximal end of the rod to the overhead support and the distal connector of the rod to the connector of the hook; placing one of the prongs on each hook through one of the mounting holes in a first of the plurality of panels and a second of the prongs on the same hook through one of the mounting holes in a second of the plurality of panels; and repeating the step of placing until all panels are attached to at least two hooks; and wherein, the bases of the first and the second panels are adjacent and closer to each other than the tops of the first and the second panels.

In an embodiment of the ceiling, the bases of first and the second panels are touching and caulk which is placed in contact with adjacent sides of the first and the second panel.

BRIEF DESCRIPTION OF THE DRAWINGS

FIG. 1 shows a cleanroom utilizing hanging ceiling panels. FIG. 1A shows a perspective view of the arrangement of a cleanroom utilizing hanging ceiling panels while

FIG. 2 shows a ceiling panel.

DESCRIPTION OF THE PREFERRED EMBODIMENT(S)

Figure 1A:
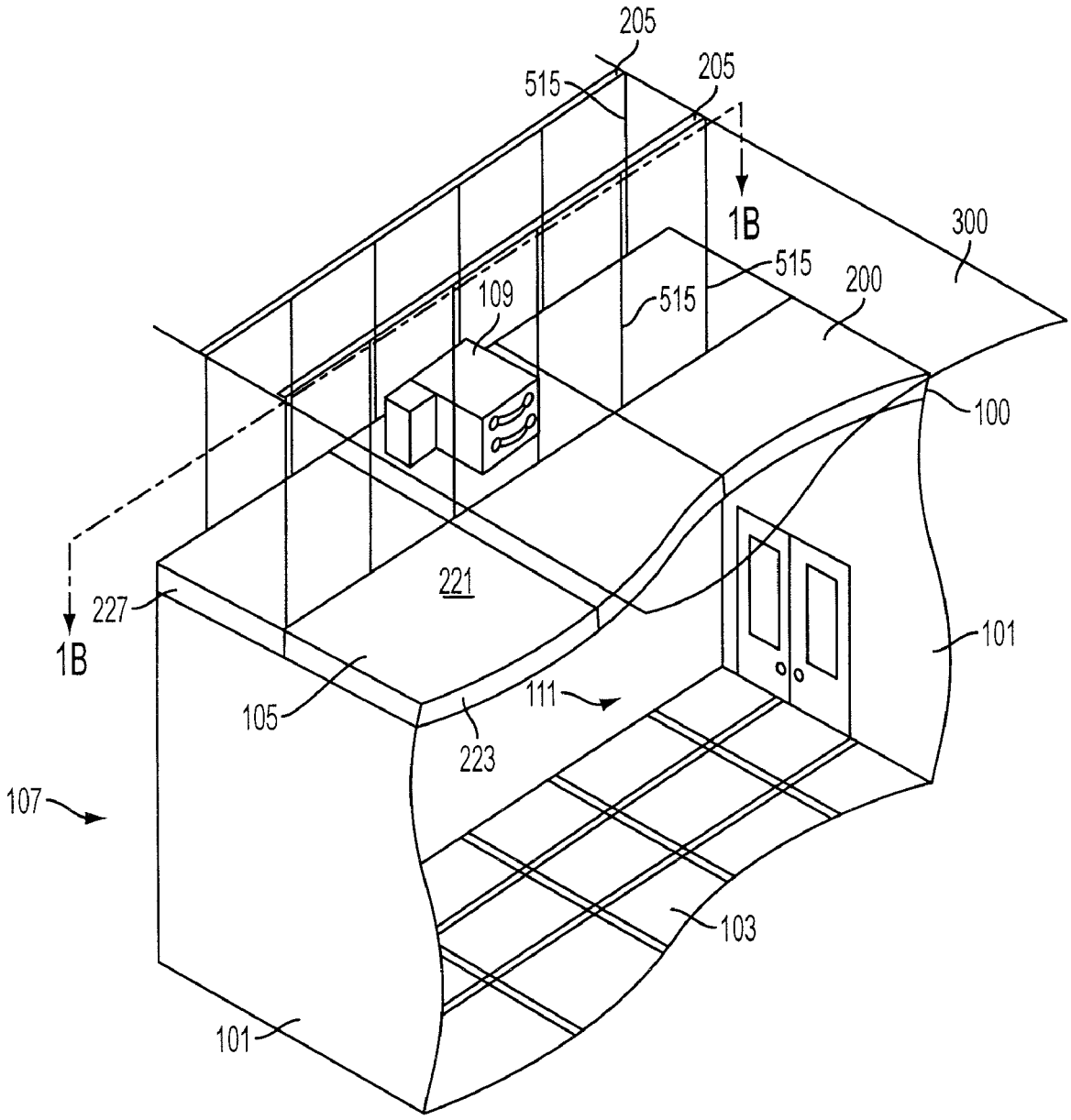

The following detailed description illustrates by way of example and not by way of limitation. Described herein, among other things, are embodiments of ceiling panels (200) which can be used to provide for the panelized ceiling (105) of a structure (100) which is generally assembled internal to another structure (300) or assembled internal to an exterior frame. Generally, the ceiling (105) is constructed so as to have as few seams (that is connection points between different structures) as possible in a panel arrangement by eliminating the need for a ceiling grid. In particular, the external structure (300), and/or external frame will serve to provide external support for the ceiling (105) particularly with the ceiling (105) being supported from above by hanging from overhead supports (205). This overhead support (205) may either be a strut channel, bar, truss, or similar structure attached to the roof of the external structure (300), or a purposefully built skeleton designed to support such a hanging ceiling (105).

Figure 1B:
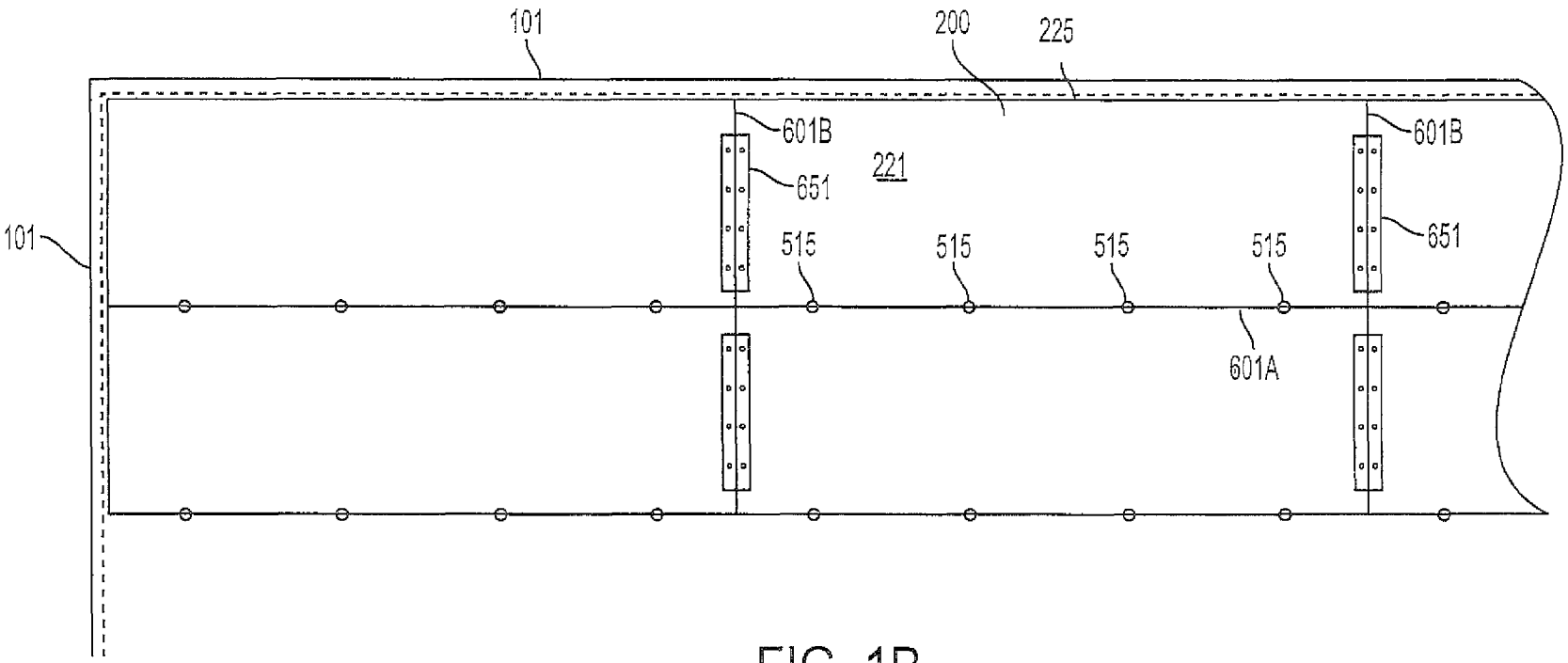
FIG. 1B shows an overhead view of a portion of the same ceiling.

FIG. 1 provides for a general embodiment of a clean room structure (100) placed inside another structure (300) in this case a warehouse or office structure. The cleanroom (100) comprises walls (101), a floor (103), and a ceiling (105). There is also an environment (107) outside the cleanroom in which there is provided an air handling system (109). The air handling system (109) serves to push air into and pull air out of the internal volume (111) of the clean room.

It should be apparent that the clean room's internal volume (111) is the area that is to remain clean. To do so, the area generally remains at least partially isolated from the environment (107) inhibiting air (or anything else) from unintentionally passing into the internal volume (111) from the environment (107). In particular, if air passes from the internal volume (111) to the environment (107), it is generally not a problem. However, it is desirable to control both what enters the internal volume (111), and what is present in the internal volume (111). For this reason, air in the internal volume (111) will be regularly removed by the air handling system (109) and cleaned. This air will then be reintroduced into the internal volume (111). In this manner the air in the cleanroom (100) has had initial particles removed therefrom, and the air handling system (109) continues to clean the air so that any newly introduced particles (such as from the humans working in the internal volume) are removed on a regular basis.

The air handling system (109), in the depicted embodiment, is located above the ceiling (105) of the internal volume (111). This is a convenient location as air flow inside the internal volume (111) is often specifically provided to be from floor (103) to ceiling (105) or vice versa. Such a flow generally serves to move particles generated by a human working in the internal volume (111) away from objects which are being worked on and are generally at similar level to the individuals. However, this also requires the ceiling (105) to be able to support the weight of the air handling system (109). Still further, as a mechanical device, the air handling system (109) will require maintenance and repair. Therefore, to be able to access the air handling system (109) it is desirable that the ceiling (105) be able to support the weight of a human being working on the air handling system (109) and walking across the upper surface of the ceiling to reach the air handling system (109). In this way, the user can access the air handling system (109) from external to the cleanroom (100) instead of having to open a hatchway or similar structure through the ceiling (105) of the cleanroom (100) introducing yet another seam or connecting point, and without need for exterior catwalks or similar structures.

The walls (101) and floor (103) of the cleanroom (100) may be of conventional construction whether modular or otherwise. The ceiling (105), in this embodiment, however, is comprised on a series of interconnected hanging panels. The ceiling (105) of FIG. 1 does not include a grid as a grid is unnecessary for support for the panels discussed herein. Instead the ceiling (105) is formed of a series of panels which are attached to individual hooks which serve to support the ceiling (105) from an overhead support (205).

Figure 2A:
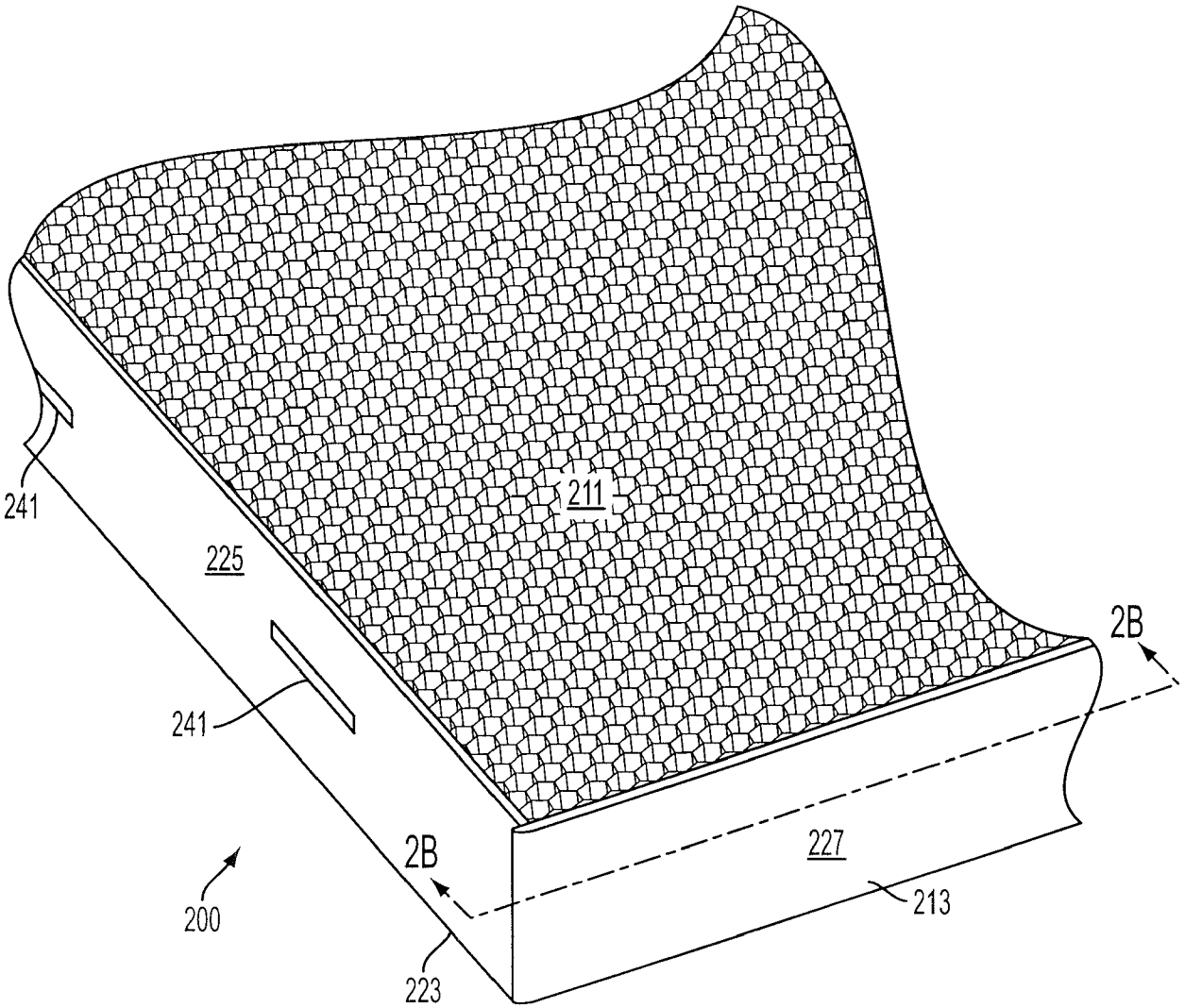
FIG. 2A provides a perspective view of the panel with the top surface removed to show internal structure.
Figure 2B:
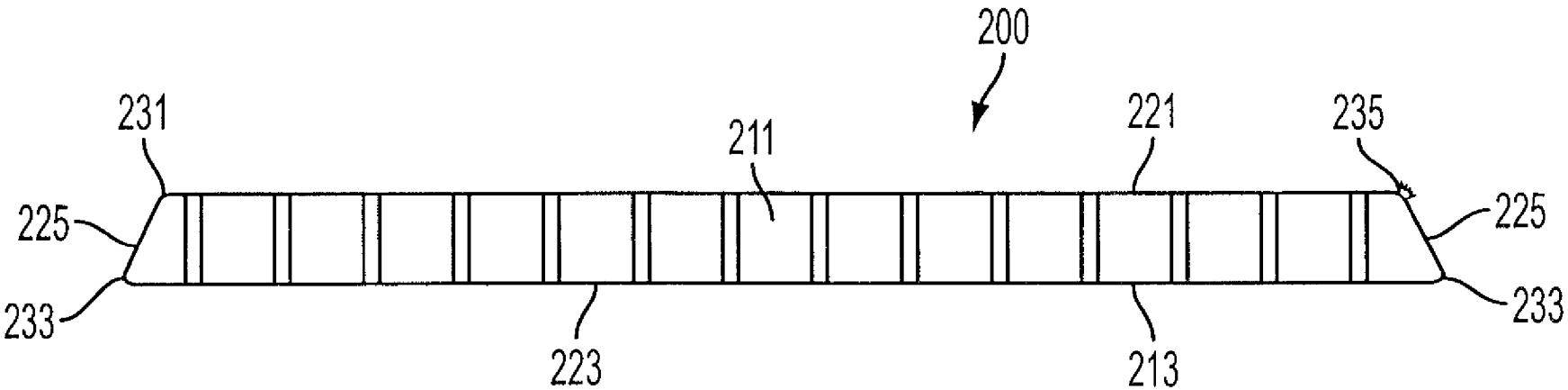
FIG. 2B shows a cut-through of the panel and FIG. 2C shows a perspective view of the panel
Figure 2C:
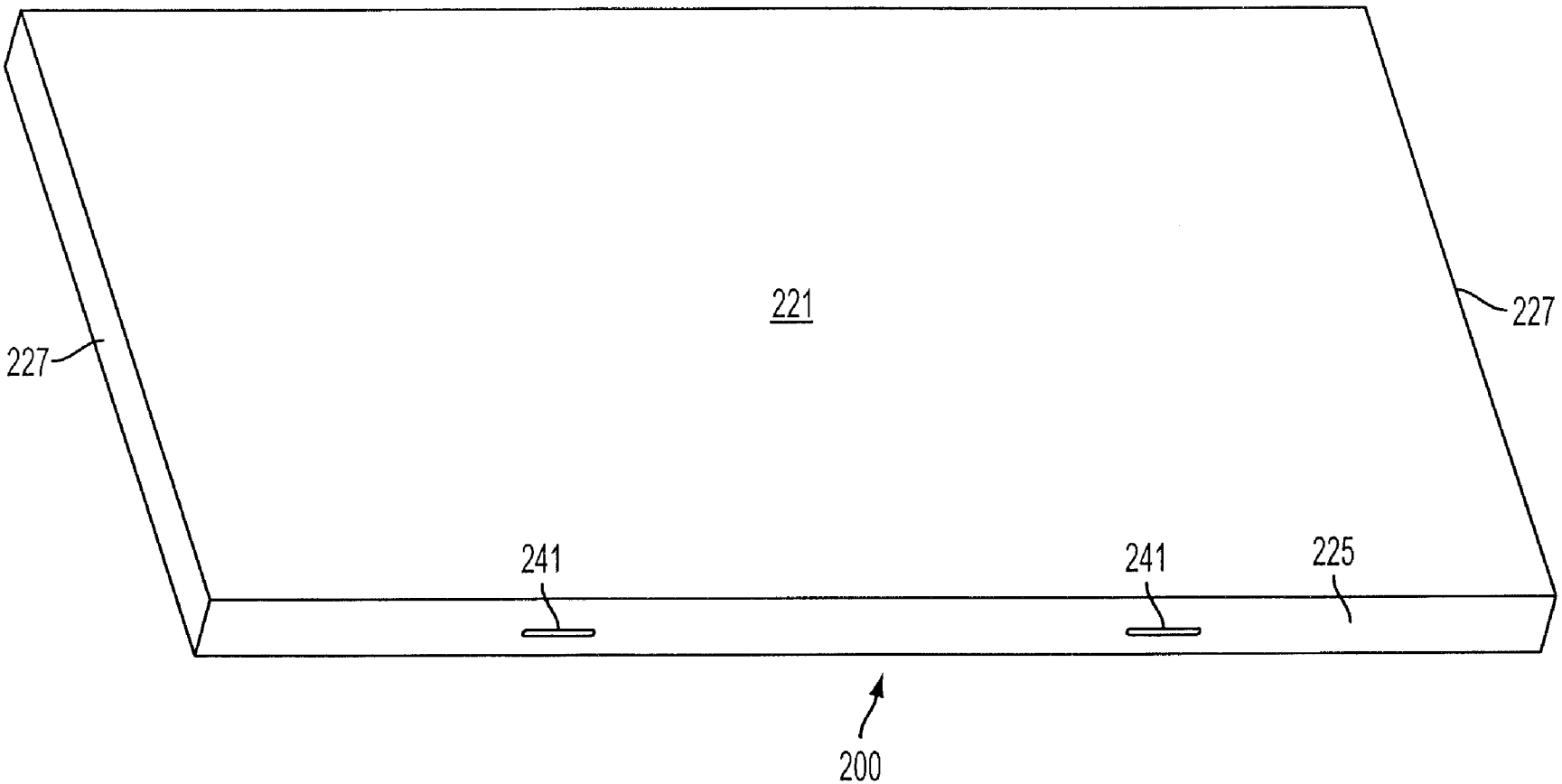

FIG. 2 provides a more detailed view of a the panel (200) a plurality of which are used to form the ceiling (105) of FIG. 1. Each of the panels (200) is generally an irregular polyhedron having an internal load bearing member (211) which is surrounded by an external shell (213). The polyhedron will generally have two major faces which comprise its top face (221) and its bottom face (223). It will also have a number of sides (225) and (227). In the embodiment of FIG. 2, each of the major faces (221) and (223) of the panel is generally rectangular so there are four sides (225) and (227). These sides are labeled long sides (225) and short sides (227) to correspond with the rectangular shape. One of ordinary skill in the art would understand, however, that any number of sides (225) and (227) may be included, the number will, generally, be based on the number of edges of each of the major faces (221) and (223) and these sides may have any appropriate size.

The internal structure (211) will generally be provided to give the panel (200) strength and may be comprised of any materials or combination of materials. In this embodiment, the internal structure (211) is a shaped aluminum honeycomb (215) formed into the same generally polyhedral shape as the panel (200), and which forms a generally rigid structure capable of load bearing. In alternative embodiments, alternative construction materials and designs may be used. For instance, the internal structure (211) may be solid, or may comprise other designs such as foams or even composite panels. It is generally preferred that the internal structure (211) be a structure capable of load bearing and therefore be a load bearing member so as to provide rigidity to the panel (200) as well as providing for strength to support the air handling system (109) as well as a person who would be able to walk on the top face (221) without the ceiling (105) collapsing.

The external shell (213) in the depicted embodiment comprises an encapsulating cover for the internal structure (211). This serves to both define the shape of the panel (200), and to provide it with a generally monolithic surface. In the depicted embodiment, the external shell (213) comprises a thin sheet of bent aluminum.

In the embodiment of FIG. 2 the shell (213) is constructed in such a fashion that there are bend points (233) formed between the bottom face (223) and the sides (225) and (227). The connections between the top face (221) and the sides (225) and (227) may be bend points (231), or may be joins (235) such as, but not limited to, caulk lines or chemical or heat welds. The use of different kinds of connections between the faces (221) and (223) and the sides (225) and (227) are preferred but not required to provide for additional elimination of possible seams in the ceiling (105). In particular, by including only bend joints (233) between the bottom face (223) and the sides (225) and (227), there are no cracks formed into which material can be harbored toward the bottom face (223) of each panel (200) instead the "connection" is solid. As the bottom face (223) will generally be used to form the actual ceiling (105) surface of the interior volume (111) of the cleanroom (100) (with the remaining structure of the panel (200) being "above" the ceiling (105) and effectively in the environment (107). This construction eliminates a first seam because the smooth nature of the bend (233) provides for a monolithic surface which is easy to clean.

The joins (231) and (235) between the top face (221) and the sides (225) and (227) are not as important as these will general not border on the internal volume of the cleanroom (100). Therefore, if these were to harbor material, it generally cannot get into the cleanroom (100) and is simply in the environment (107). Further, even if material was to get internal to the panel (200) from a join such as (235), it generally cannot pass out of the panel (200) into the cleanroom (100) because of the monolithic construction of the bends (233) inhibiting such passage. Instead, the material would be held internal to the panel (200).

In an alternative embodiment of panel (200), the internal structure (211) and the external shell (213) may comprise a single construction as opposed to two separate constructions as illustrated in FIG. 2. For instance, the panel (200) may be constructed of a slab of aluminum. This is generally not preferred due to weight and expense, however it does comprise an embodiment of the current invention. In this case, the external shell (213) and internal structure (211) are essentially the same component, however, the two components are referred to separately for clarity as in such a case the external shell (213) is effectively simply the outer surface of the slab and items which would pass through the external shell (213) would still so pass through.

In the depicted embodiment, the panel (200) is formed to be a partial pyramidal frustum formed from a rectangular or square base. The shape is called a partial frustum in some embodiments because not all the sides tilt inward as would be the case in a true frustum. In particular, in the embodiment of FIG. 2, the two short sides (227) are in fact parallel to each other and extend generally perpendicular to the bottom face (223) and top face (221) while the two long sides (225) follow the generally frustum shape and extend inward toward the internal structure (211) when moving from the bottom face (223) toward the top face (221). In an alternative embodiment, angled walls may also be included as the short sides (227) making the device a true frustum.

In each of the long sides (225), as can be seen in FIG. 2A, there is included at least one, and generally three mounting holes (241). These are arranged at intervals on each long side (225) and are generally evenly spaced from the center point of each long side (225) of the panel (200). This provides a panel (200) generally resembling that shown in FIG. 2. The mounting holes (241) preferably extend along a line parallel to the top (221) and bottom (223) faces of the panel (200) to form elongated openings. In the depicted embodiment, only the long sides (225) include the mounting holes (241). This is by no means required and in alternative embodiments the short sides (225) may additionally or alternatively include mounting holes (241). Generally, the mounting holes (241) will only be positioned on sides which are angled inwards since, as discussed later, the mounting holes (241) are used to interface with hooks (400) while still providing clearance for those hooks (400) when the panels are formed into the ceiling (105). However, in alternative embodiments, this is not necessary.

Figure 3:
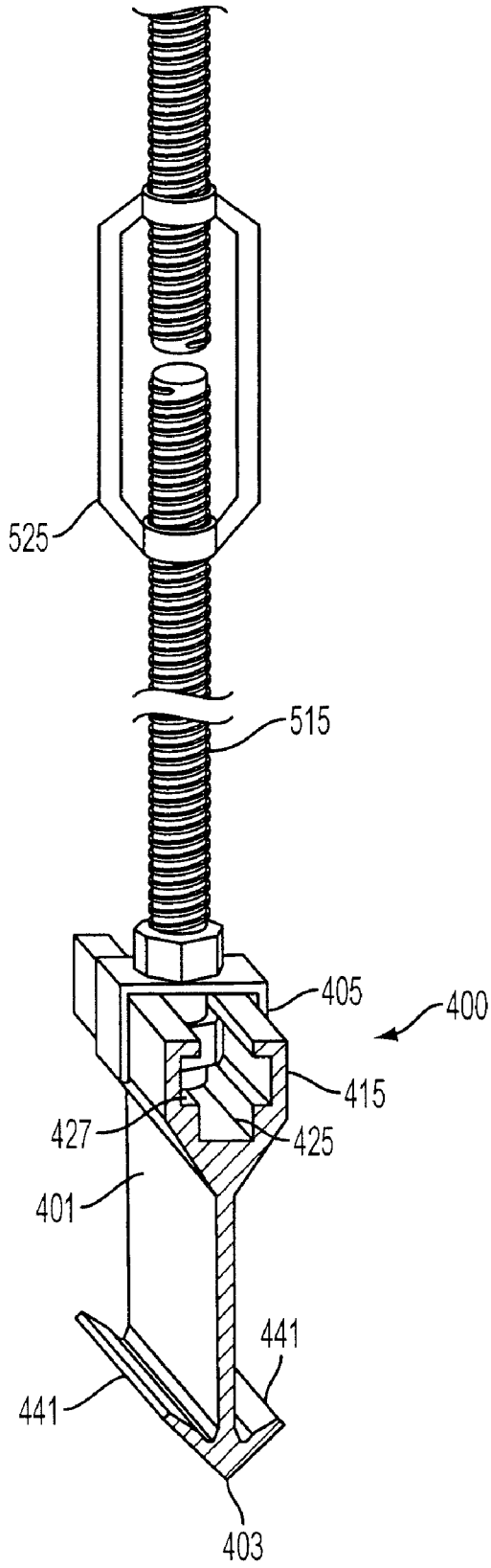
FIG. 3 shows a perspective view of a hanging hook.
Figure 4:
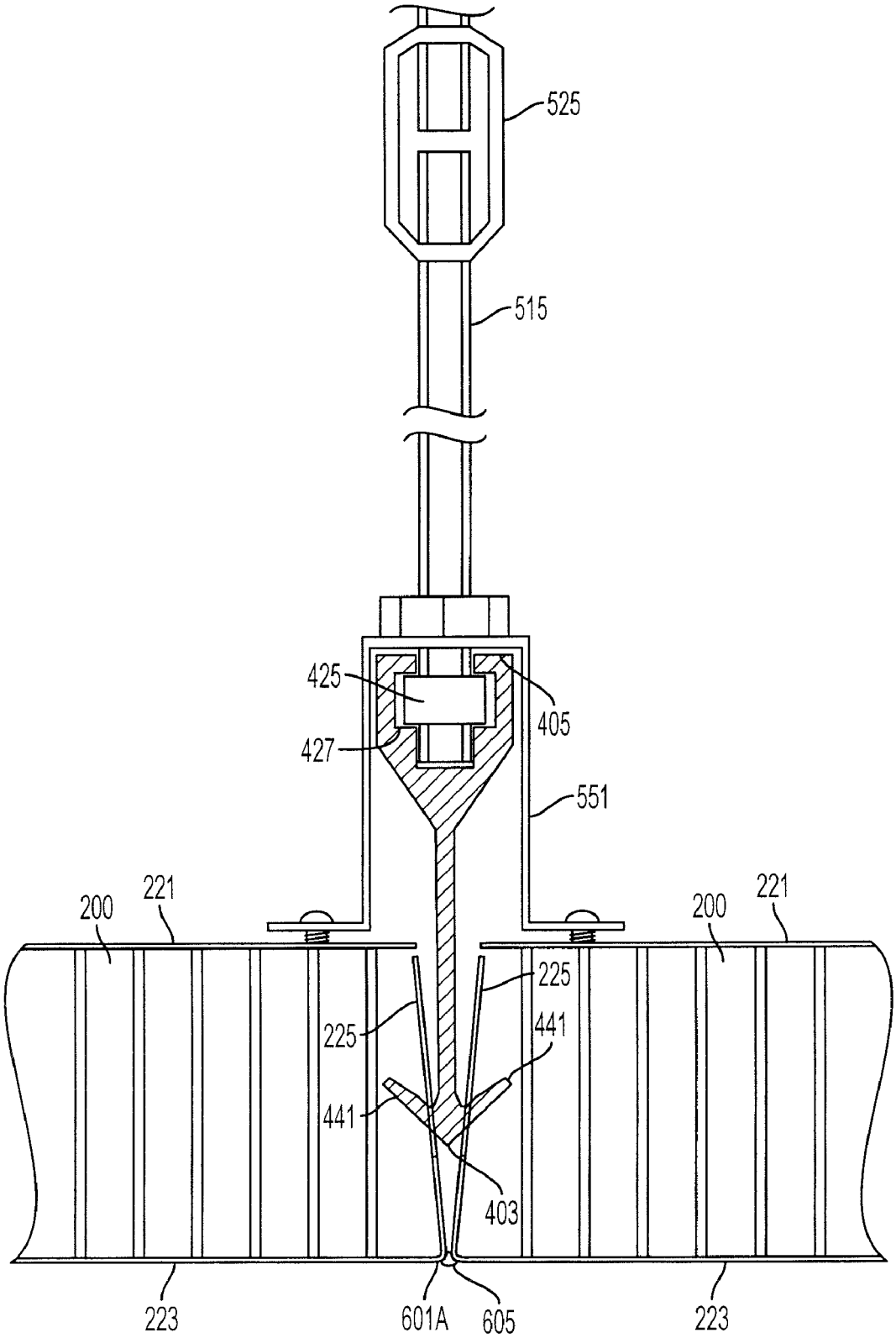
FIG. 4 shows a cut-through drawing of two ceiling panels and a hanging support structure which provide for the connection point between two panels.

The panels (200) are used in conjunction with hanging hooks (400) such as those shown in FIG. 3. Each hook (400) will generally comprise a main body portion (401) of a generally elongated flattened construction and including a distal (403) and proximal (405) end and a length therebetween. At the distal end (403) there are located two prongs (441). Each prong is generally elongated in such a manner as to produce a "scoop" type shape as is visible in FIG. 3. The prongs (441) will each extend at an acute angle to the length of the main body (401) resulting in the hook (400) appearing like that of an arrowhead in cross-section as shown in FIG. 4. At the proximal end (405) of the main body (401) there is provided a connector (415). The connector (415) may be of any type but will generally be internally threaded in a manner so as to be lockingly threaded with a rod (515) or may include, as shown in FIG. 4 an internal nut (425) held in a groove (427) into which a threaded rod (515) may be connected.

Figure 5:
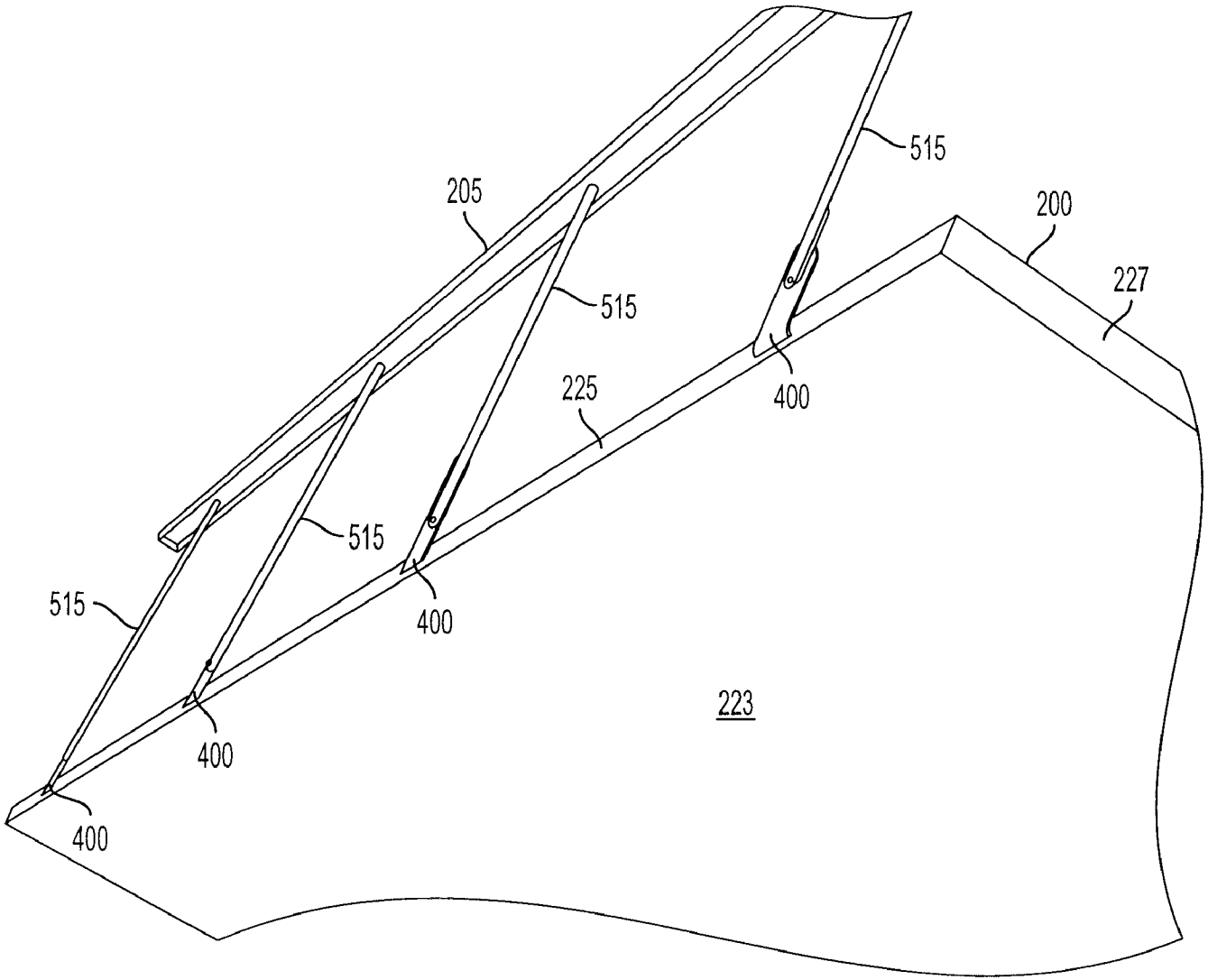
FIG. 5 shows a perspective view of a single panel connected to a number of hooks.

To create the ceiling (105) from the panels (200) in a preferred embodiment one would generally hang the panels (200) from the hooks (400) by placing the prongs (441) in the mounting holes (241). A cut-through of two adjacent panels (200) and a single connection hook (400) as they would usually be arranged is shown in FIG. 4, FIG. 5 provides a perspective view of a single panel (200) attached to a series of hooks (400) connected to an external support (205) to show the hanging structure. In alternative embodiments, the ceiling panels could be supported by alternative structures such as column and beam arrangements instead of being hung. These, however, are generally less preferred as they will often result in the creation of additional seams.

To support the ceiling panels (200) in place and form the ceiling (105), a plurality of rods (515) are provided which are attached to the overhead support (205). Generally so as to be suspended from overhead support (205) and hold the ceiling (105) in place, these rods (515) are sized and shaped to allow the ceiling (105) to be hung at the desired height from the overhead supports (205), and may include adjustment mechanisms (525) to provide that positioning. The proximal ends (405) of the hooks (400) will be generally screwed onto a distal end (505) of the rods (515) and generally firmly locked in place to provide for support such as by gluing the threads. This connection may be further reinforced by the inclusion of a strapping bracket (551) which extends over the connection and attaches to the top face (221) of the panel (200). This can provide additional force distribution, if required, or can serve to cover the hook (400) to improve appearances and inhibit items from becoming caught in the hook (400) connection. An embodiment of such an optional bracket is shown in FIG. 4. A plurality of rods (515) is generally placed on the overhead supports (205) so as to form lines of rods (515) as can be seen in FIGS. 1 and 5.

Panels (200) are attached to the hooks (400) and thus the rods (515) so that one prong (441) of each hook (400) is placed in a mounting hole (241) in a side (225) of the panel (200). As can be seen in FIG. 5, the shape of the prongs (441) is such that the panels (200) will generally be inclined to hang relatively horizontal. This process is repeated for neighboring panels (200) until the ceiling (105) is completed. As should be apparent from the FIGS. At the edge of the ceiling (105), a half-hook (400) with only a single (instead of the double) prong (441) will generally be used to hang the ceiling (105) adjacent to the wall (101). Alternatively, an angle bracket or similar structure may be used to attach the ceiling to the walls.

Once all the panels (200) are positioned, the ceiling (105) has essentially been formed. As can be seen in FIG. 1 there are basically four joins (601) for each panel (200) to an adjacent panel (200) or the wall (101). The two long side joins (601A) are as shown in FIG. 4 while the short side joins (601B) are as shown in FIG. 6.

As can be best seen in FIG. 4, because of the partial frustum pyramid shape of the panels (200), the main body (401) of the hook (400) can be placed between adjacent sides (225), and between adjacent top faces (221) which are separated by a larger amount of space to accommodate the main body (401) of the hook (400) than the bottom faces (223) of adjacent panels (200) which are in very close proximity, if they are not touching. The small seam or crevice forming the join (601A) between the bottom faces (223) can be filled with a putty, gel, caulk, foam, or other material (605) that is designed to fill gaps being placed into the seam between the adjacent panels. In an embodiment, a small brace or extension (not shown) may extend from one or both of the long sides (225) or be placed between the long sides (325) to provide a back stop for such caulk, gel or putty (605).

Figure 6:
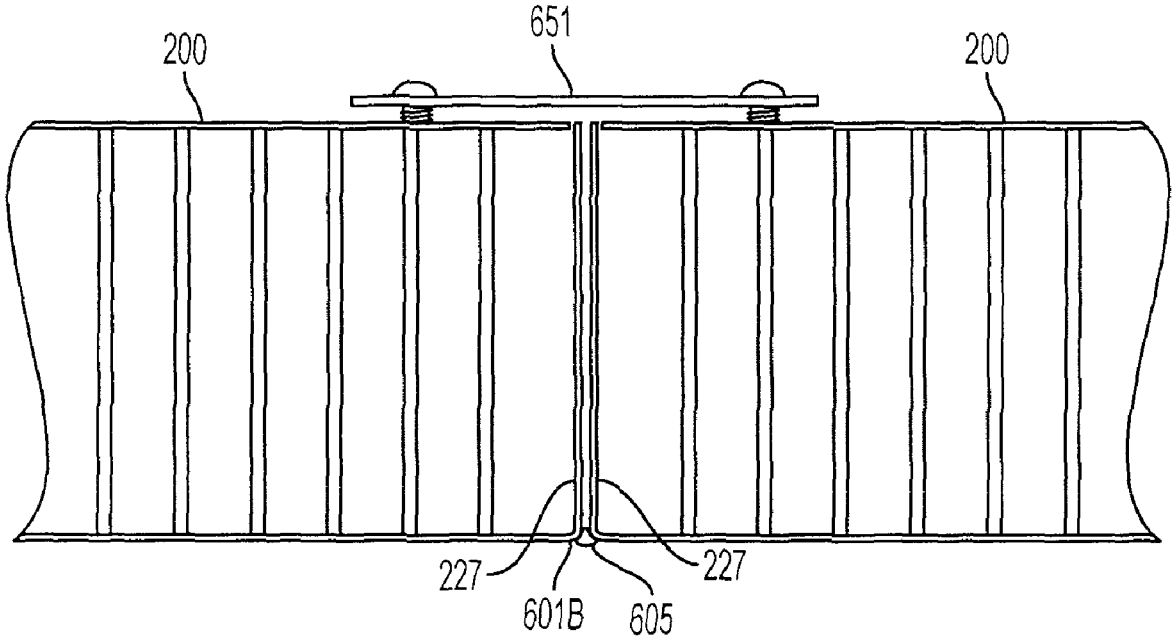
FIG. 6 shows a cut through drawing of a second connection point between two panels.

As shown in FIG. 6, on the short sides (227), the sides (227), which are generally parallel to each other, are also close or touching along their entire surface as there is no need to make room for the hooks (400). This means the edges of the top faces (221) are generally closer here than they are along the long sides (225). Again, the gap forming the join (601B) between the two bottom faces (223) may be filled with caulk or other material (605) to close the gap. There may also be included a connection panel (651) which is used to connect the panels (200) together rigidly by being bolted, screwed or otherwise attached to the top faces (221) of two adjacent panels (200).

While the embodiments of FIGS. 4 and 6 provide for different types of connection at the long sides (225) compared to the short sides (227), one of ordinary skill in the art would see that this is not the only way the panels (200) can be connected. In an alternative embodiment, the methodologies on the short sides (227) and long sides (225) may be reversed. Alternatively, the connection of FIG. 4 could be used on every side. In still a further embodiment, the side around the holes (241) may be angled, but other portions of the side may not be combining the two connections on the same face. In a still further embodiment, the connection of FIG. 6 can be used on every side. In this embodiment, however, the side mount hooks (400) would generally not be used as they would generally force the panels (200) too far apart in clearing the top surfaces to provide a small enough crease to be caulked (although it could be used this way if the hooks (400) main body (401) were sufficiently narrow). Generally, in this type of embodiment, the hooks (400) would attach directly to the top face (221) of the panel (200) instead of to the sides (225) or (227). For instance, the internal structure (211) may include a support molding or other structure which the hooks (400) connect to by passing through the top face (211).

Regardless of the embodiment used, in the end, the bottom faces (223) of the panels (200) forming the ceiling (105) end up being virtually next to each other, and with appropriate design can in fact sit so as to be touching in a preferred embodiment. The thin gap between them is then filled with caulk or similar material (605) to provide for sealant of the seam. In such a construction the bottom face (223), which forms the ceiling (105) surface of the cleanroom (100) is therefore relatively monolithic and includes only one seam (601) at each junction between panels and that seam (601) is relatively tight and easily filled with a relatively small amount of a connection material (605). This provides for a very easy to clean surface. Further, the connection material (605) will generally provide for a relatively smooth transition between the adjacent panels (200).

As opposed to a ceiling which uses a grid, this ceiling (105) will generally only have half as many seams (601) in the final construction as a grid based system requires two joins between each adjacent panel. Specifically, a join between the first panel and the grid and a join between the second panels and the grid. Still further, in many grid system, the grid channel itself includes a join. In the depicted ceiling (105), there is only a single join (601) between any two adjacent panels. This can provide, in an embodiment, a ceiling with an essentially flat monolithic surface.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A panelized ceiling for a cleanroom, the ceiling comprising:

a plurality of constructed panels, each panel including:

an internal load bearing member;

a polygonal top face placed on top of said internal load bearing member;

a polygonal bottom face placed under said internal load bearing member;

at least three sides connecting said top face to said bottom face in such a manner as to enclose said internal load bearing member, at least two of said sides being arranged so as to angle inward toward said internal load bearing member from the edges of said bottom face, each of said at least two sides including at least two independent mounting holes therein;

a plurality of hooks, each of said hooks including:

a main body with a distal and a proximal end and a length therebetween;

at least two prongs, arranged toward said distal end of said main body and extending from said main body toward said proximal end at an acute angle to said length; and a connector located toward said proximal end; and a plurality of rods, each of said rods being connected to an overhead support and having a distal connector;

wherein, said ceiling is formed by attaching a proximal end of said rod to said overhead support and said distal connector of said rod to said connector of said hook; placing one of said prongs on each hook through one of said mounting holes in a first of said plurality of panels and a second of said prongs on said same hook through one of said mounting holes in a second of said plurality of panels; and repeating said step of placing until all panels are attached to at least two hooks;

wherein, said bases of said first and said second panels are adjacent and closer to each other than said tops of said first and said second panels; and wherein said hook attached to said first and said second panels does not contact either of said bases of said first and said second panels, and does not contact said load bearing member.

2. The ceiling of claim 1 wherein said bases of first and said second panels are touching.

3. The ceiling of claim 1 further comprising, caulk which is placed in contact with adjacent sides of said first and said second panel.

4. The ceiling of claim 1 wherein said internal load bearing member comprises a honeycomb.

5. The ceiling of claim 4 wherein said honeycomb is constructed of aluminum.

6. The ceiling of claim 1 wherein said top face, said bottom face, and said sides are constructed of a material selected from the group consisting of aluminum and steel.

7. The ceiling of claim 1 wherein said bottom face and said sides are constructed of a single sheet bent into shape.

8. The ceiling of claim 7 wherein said bottom face, said top face and said sides are constructed of a single sheet bent into shape.

9. The ceiling of claim 8 wherein said top face is attached by a bend to a single one of said sides.

10. The ceiling of claim 9 wherein said top face is bonded to at least one of said sides.

11. The ceiling of claim 10 wherein said top face is bonded by adhesives.

12. The ceiling of claim 1 wherein said bottom face is a quadrilateral.

13. The ceiling of claim 12 wherein said bottom face is rectangular.

* * * * *